US006609567B2

(12) United States Patent
Ingram et al.

(10) Patent No.: US 6,609,567 B2
(45) Date of Patent: Aug. 26, 2003

(54) TUBING HANGER WITH LATERAL FEED-THROUGH CONNECTION

(75) Inventors: Gary Ingram, Richmond, TX (US); Patrick J. Zimmerman, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/848,898

(22) Filed: May 4, 2001

(65) Prior Publication Data

US 2002/0162667 A1 Nov. 7, 2002

(51) Int. Cl.[7] ..... E21B 23/08
(52) U.S. Cl. ..... 166/126; 166/129; 166/133
(58) Field of Search ..... 166/120, 217, 166/138, 123, 179, 125, 126, 129, 131, 133

(56) References Cited

U.S. PATENT DOCUMENTS

| | | | | |
|---|---|---|---|---|
| 3,085,628 A | | 4/1963 | Malone | 166/187 |
| 3,804,164 A | * | 4/1974 | Ellis | 166/120 |
| 4,424,861 A | * | 1/1984 | Carter, Jr. et al. | 166/120 |
| 4,505,332 A | * | 3/1985 | Mills et al. | 166/120 |
| 4,649,995 A | | 3/1987 | Read | 166/115 |
| 4,754,812 A | * | 7/1988 | Gentry | 166/313 |
| 4,798,243 A | | 1/1989 | Curington et al. | 166/65.1 |
| 4,981,177 A | | 1/1991 | Carmody et al. | 166/376 |
| 5,184,677 A | | 2/1993 | Dobscha et al. | 166/187 |
| 5,343,949 A | * | 9/1994 | Ross et al. | 166/278 |
| 5,810,083 A | | 9/1998 | Kilgore | 166/120 |
| 6,026,897 A | | 2/2000 | Pringle et al. | 166/65.1 |
| 6,220,362 B1 | | 4/2001 | Roth et al. | 166/380 |
| 6,467,540 B1 | * | 10/2002 | Weinig et al. | 166/120 |

OTHER PUBLICATIONS

PCT Partial International Search Report from International Application No. PCT/GB02/01982, Dated Jul. 24, 2002.

* cited by examiner

*Primary Examiner*—Frank Tsay
(74) *Attorney, Agent, or Firm*—Moser, Patterson & Sheridan, L.L.P.

(57) ABSTRACT

A packer and method for sealing an annulus in a wellbore is provided. In one aspect the packer comprises a body having one or more conduits formed there-through; a chamber disposed within the body, wherein the chamber is in fluid communication with each of the one or more conduits; and an aperture for pressurizing the chamber. In another aspect, the packer comprises a body having one or more conduits formed there-through; a lock body disposed on a first end of the body; a collapsible member threadably engaged to the body at a first end and shouldered against the lock body at a second end; and a slideable member disposed within the collapsible member. In yet another aspect, the packer comprises a body having one or more conduits formed there-through, wherein the one or more conduits comprises an enlarged first end; and a cutting member disposed with the enlarged first end.

25 Claims, 11 Drawing Sheets

FIG.8
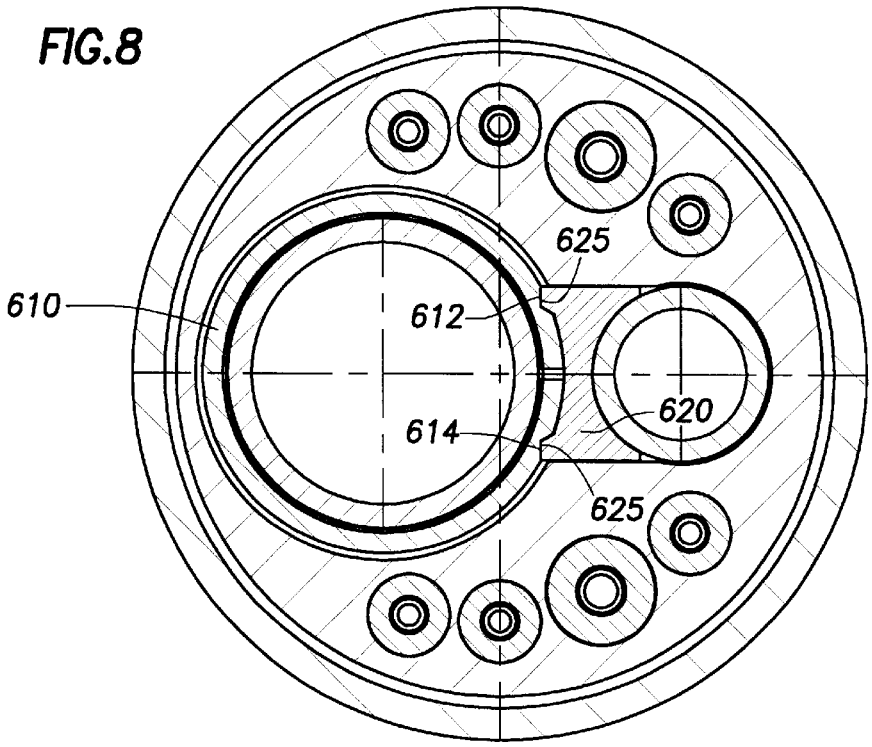
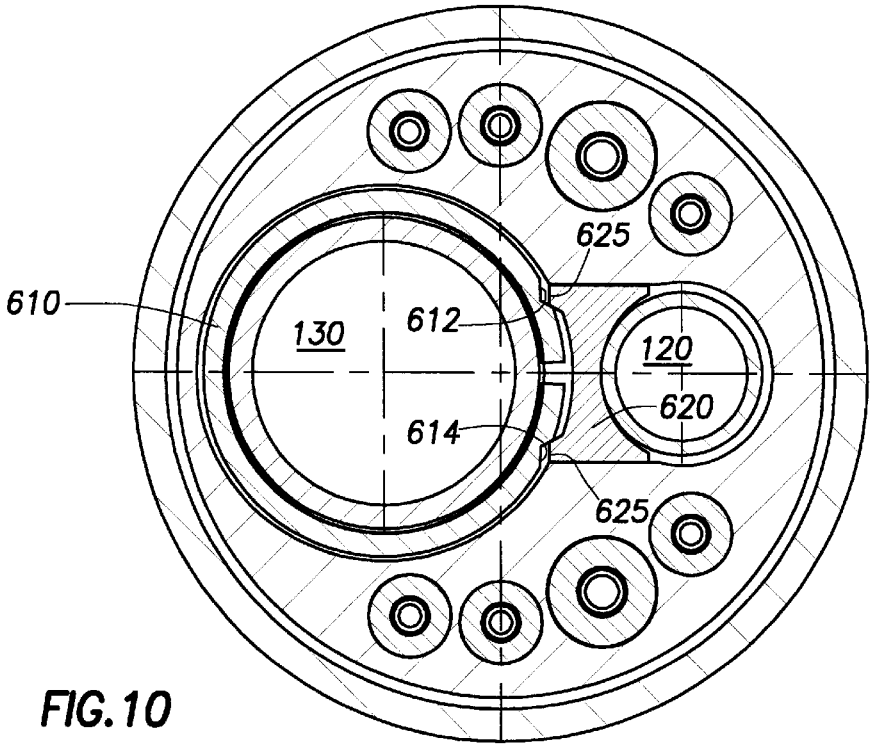
FIG.10

TUBING HANGER WITH LATERAL FEED-THROUGH CONNECTION

BACKGROUND OF THE INVENTION

Field of the Invention

The present invention relates to downhole packers. More particularly, the present invention relates to a downhole packer with feed-through connections for communication conduits and a method for pressure testing the connections.

BACKGROUND OF THE RELATED ART

Field of the Invention

Downhole packers are typically used to seal an annular area formed between two co-axially disposed tubulars within a wellbore. For example, downhole packers may seal an annulus formed between production tubing disposed within well bore casing. Alternatively, packers may seal an annulus between the outside of a tubular and an unlined borehole. Routine uses of packers include the protection of casing from pressure, both well and stimulation pressures, as well as the protection of the wellbore casing from corrosive fluids. Other common uses include the isolation of formations or leaks within a well bore casing or multiple producing zones, thereby preventing the migration of fluid between zones. Packers may also be used to hold kill fluids or treating fluids within the casing annulus.

Conventional packers typically comprise a resilient sealing element located between first and second retaining rings. The sealing element is typically a synthetic rubber composite which can be compressed by the retaining rings to expand radially outward into contact with an inner surface of a well casing there-around. The compression and expansion of the sealing element seals the annular area by preventing the flow or passage of fluid across the expanded sealing element.

Conventional packers are typically run into a wellbore within a string of tubulars and anchored in the wellbore using mechanical compression setting tools or fluid pressure devices. Conventional packers are also typically installed using cement or other materials pumped into an inflatable sealing element.

During the production of a well, downhole devices are often controlled or otherwise in communication with above-ground equipment. For example, a control panel above the earth's surface may direct a downhole valve to open or close, a sleeve to shift, or a motor to turn on or off. Data is also collected through the use of downhole devices and transmitted to the surface. For example, data may include pressure readings, temperature readings, flowing velocities, or flow rates. Data sent to and from the surface may be transmitted through a control line such as an electrical wire, fiber optic, or hydraulic conduit.

Control lines connecting the surface equipment and the downhole devices are typically placed in the annulus between the well casing and the production tubing. For devices above a packer this is easily accomplished since the annulus is unobstructed. However, devices below a packer present a challenge since the annulus is sealed off. Packers of the prior art have provided for control lines to pass through the sealing element. One disadvantage associated with running the control lines through element is that the mechanical integrity of the sealing element is compromised. Another disadvantage is that an effective seal between the sealing element and the control lines traversing there-through is difficult to establish and even more difficult to maintain.

Therefore, packers have recently provided for the control lines to pass longitudinally there-through. However, one disadvantage associated with packers of this type is pressure testing each and every connection disposed within the packer. Pressure testing each and every connection consumes valuable time prior to running the packer down the hole. Another disadvantage arises in these packers upon the retrieval of the packer from the well bore. Upon retrieval of the packer from the well bore, the control lines are simply stretched until they break. There is no way to determine how much force is required to break the control lines, and there is no way to determine where the control line will physically break.

Furthermore, retrievable packers typically have a release mechanism disposed within a larger bore of a multi-bore packer because of the weight of the attached tubing string. The cross sectional area of a small bore is simply too small to handle the weight of an attached tubing string. One problem associated with having the release mechanism disposed within the large bore is that the larger bore is often in communication with the production tubing. Often times, the release mechanism becomes jammed or stuck due to an accumulation around the release mechanism of waxy paraffins from within the production fluid, making the packer difficult or near impossible to release.

Therefore, there is a need for a downhole packer having a release mechanism disposed within a small bore that can withstand the weight of the attached tubing string. There is also a need for a packer with internal communication conduits having a cutting mechanism for controllably severing the control lines disposed there-through. There is further a need for a packer having one or more internal communication conduits having one test port to pressure test each connection of the packer thereby saving time and resources prior to running the packer down the hole.

SUMMARY OF THE INVENTION

In one aspect, a packer is provided having a release mechanism disposed within a small bore that can withstand the weight of the attached tubing string. In one aspect, the packer comprises a body having one or more conduits formed there-through; a lock body disposed on a first end of the body; a collapsible member threadably engaged to the body at a first end and shouldered against the lock body at a second end; and a slideable member disposed within the collapsible member. In another aspect, the packer comprises a lock body disposed on a first end of the body, wherein the lock body comprises a recessed groove formed in an inner surface thereof; an expandable ring disposed within the recessed groove, wherein the expandable ring comprises concentric grooves disposed on an inner surface thereof which matably engage concentric grooves disposed about an outer surface of the body; a releasable collar at least partially disposed about the expandable ring; and a slideable sleeve at least partially disposed about the releasable collar.

A packer is also provided with internal communication conduits having a cutting mechanism for controllably severing the control lines disposed therethrough. In one aspect, the packer comprises a body having one or more conduits formed there-through, wherein the one or more conduits comprises an enlarged first end; and a cutting member disposed with the enlarged first end. Movement of the body compresses the cutting member into a control line disposed within the conduit thereby controllably severing the control line.

A packer is further provided with one or more internal communication conduits having one test port to pressure test each connection of the packer thereby saving time and manpower. In one aspect, the packer comprises a body having one or more conduits formed there-through; a chamber disposed within the body, wherein the chamber is in fluid communication with each of the one or more conduits; and an aperture for pressurizing the chamber. Pressurized fluid flows in a first direction through a first conduit to the chamber and flows in a second direction from the fluid chamber through each conduit.

In addition, a method for retrieving a packer from a well bore is provided. In one aspect, the method comprises attaching a retrieval tool to a body, the body comprising one or more conduits formed there-through; a lock body disposed on a first end of the body, wherein the lock body comprises a recessed groove formed in an inner surface thereof; a ring disposed within the recessed groove, wherein the ring comprises concentric grooves disposed on an inner surface thereof which matably engage concentric grooves disposed about an outer surface of the body; a collar at least partially disposed about the ring; and a sleeve at least partially disposed about the collar; moving the sleeve from a first position to a second position using the retrieval tool; releasing the collar; and then expanding the ring. In another aspect, the method comprises attaching a retrieval tool to a body, wherein the body has one or more conduits formed there-through; a lock body disposed on a first end of the body; a collapsible member threadably engaged to the body at a first end and shouldered against the lock body at a second end; and a slideable member disposed within the collapsible member. The retrival tool is used to move the slideable member from a first position to a second position thereby disengaging the collapsible member from the lock body. Movement of the slideable member allows the collapsible member to collapse inwardly and release the packer.

Further, a method of severing a control line in a well bore is provided. The method comprises releasing a body, the body comprising: one or more conduits formed there-through, wherein the one or more conduits comprises an enlarged first end; one or more control lines disposed within the one or more conduits; and a cutting member disposed with the enlarged first end; and compressing the cutting member. The cutting member has a sharp edge disposed thereto that controllably severs the control lines disposed through the conduits.

Still further, a method of pressure testing conduits of a packer is provided. In one aspect, the packer comprises flowing a fluid into a body, wherein the body has one or more conduits formed there-through, wherein the one or more conduits comprises a seal mandrel disposed therein and an annular cavity formed between an outer surface of the seal mandrel and an inner surface of the body; and a chamber disposed within the body, wherein the chamber is in fluid communication with the annular cavities. The chamber acts as a manifold for pressure testing the one or more conduits. The pressurized fluid flows in a first direction through a first annular cavity to the chamber and flows in a second direction from the fluid chamber through each annular cavity.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 8 is a section view along lines 8—8 of FIG. 7.

FIG. 10 is a section view along lines 10—10 of FIG. 9.

DETAILED DESCRIPTION OF THE PREFERRED EMBODIMENT

Figure 1A:
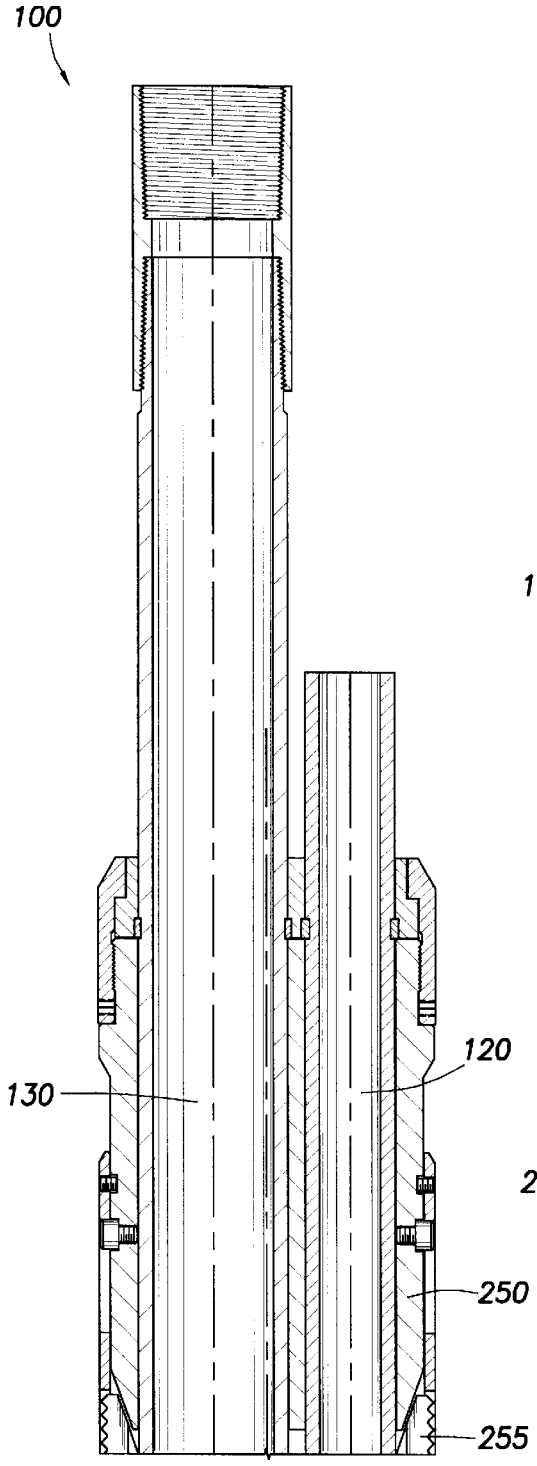
FIGS. 1A–1D are a section view of a packer of the present invention shown in a run position.
Figure 1B:
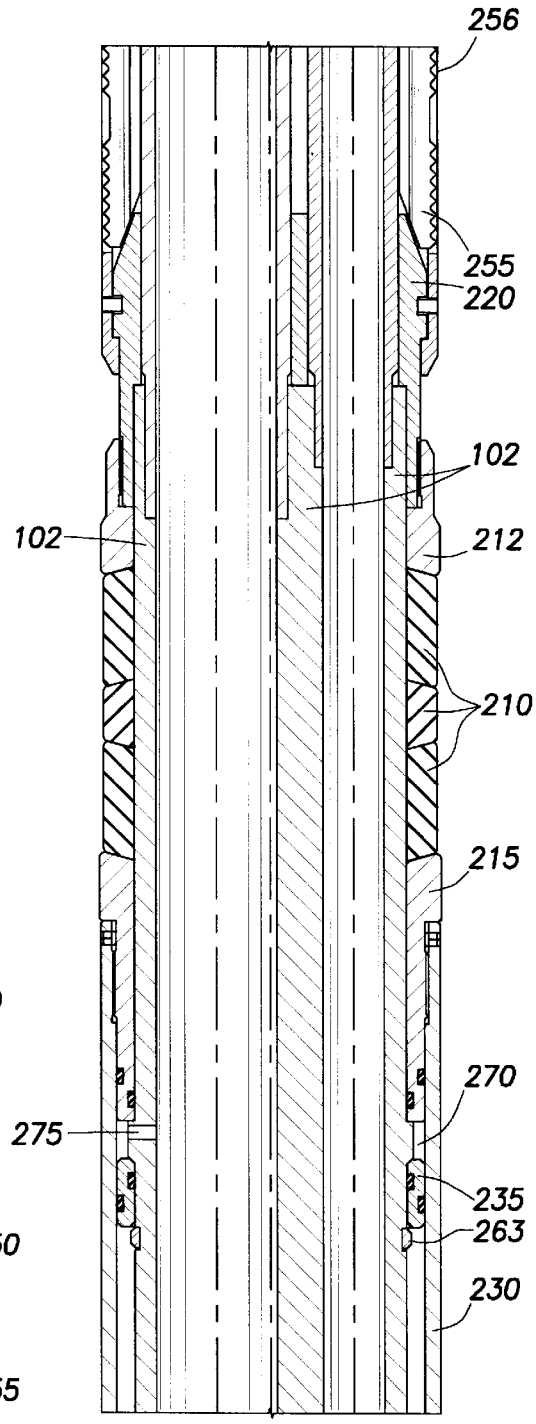

FIGS. 1A–1D are a section view of a packer 100 of the present invention shown in a run position. The packer 100 includes a body 102 having an engagement assembly, a body lock ring assembly, a retrieval assembly, and one or more control line assemblies disposed thereon. For ease and clarity of description, the packer 100 will be described in more detail below as if disposed within a tubular in a vertical position as oriented in the FIGS. 1–10. It is to be understood, however, that the packer 100 may be disposed in any orientation, whether vertical or horizontal. It is also to be understood that the packer 100 may be disposed in a bore hole without a tubular there-around.

Referring to FIGS. 1A–1D, the body 102 is a cylindrical member having one or more longitudinal bores formed there-through. As shown, the body includes two longitudinal bores 120, 130, for communication with tubing string. The first bore 120 typically has a smaller inner diameter and is known as the "small" bore. The second bore 130 typically has a larger inner diameter and is known as the "large" bore. During operation, the small bore 120 is often used to flow inhibitors, diluents, or other chemicals to a selected zone of a well bore that has been chemically treated, for example. Conversely, the large bore 130 is often connected to, or otherwise in fluid communication, with a production string carrying production fluids from within the well bore.

Figure 1C:
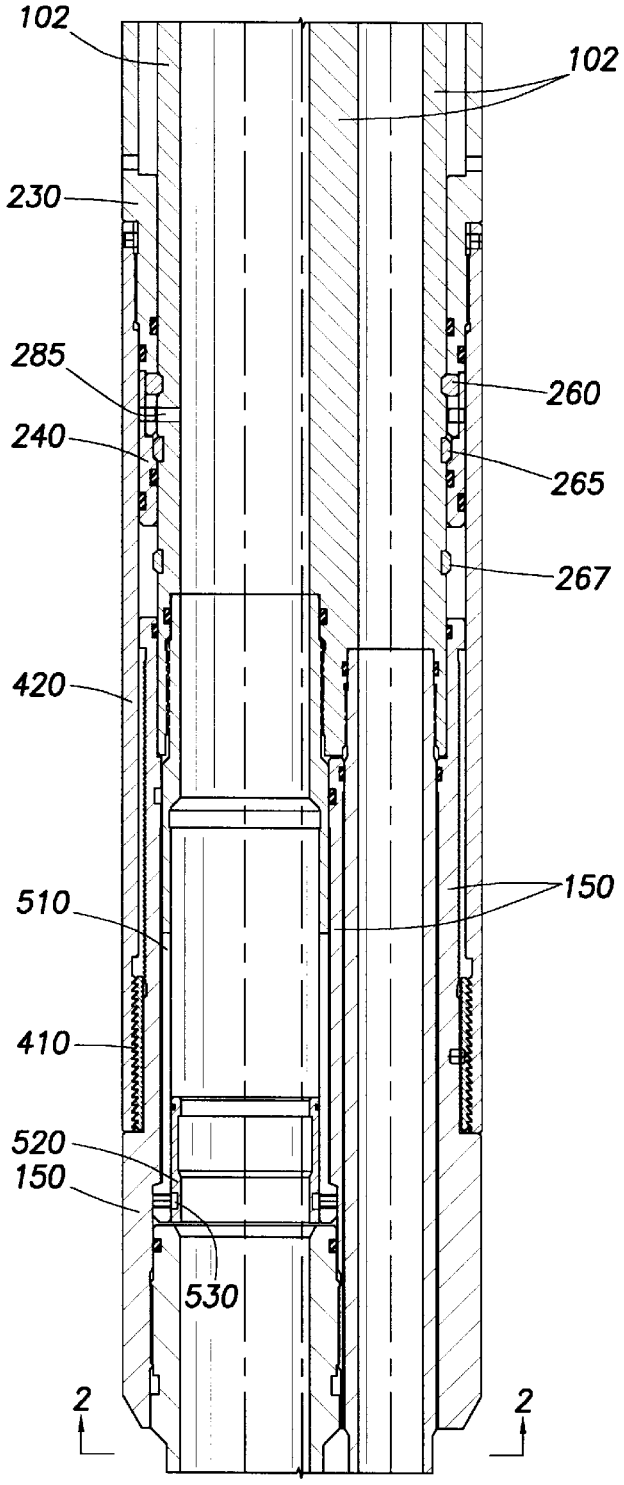
Figure 1D:
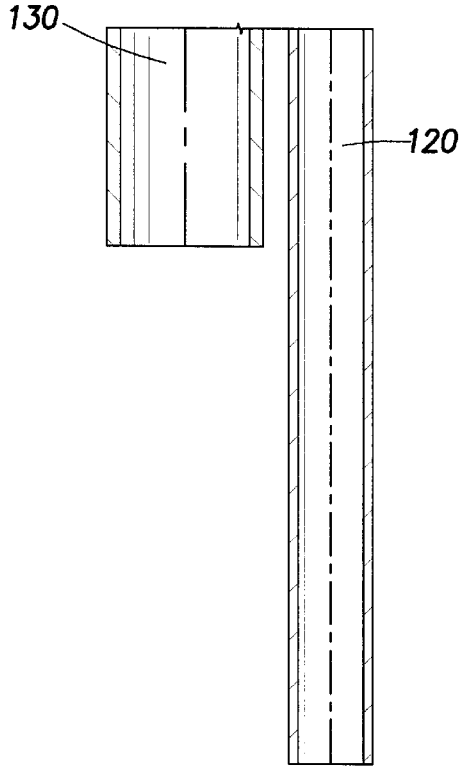
Figure 2:
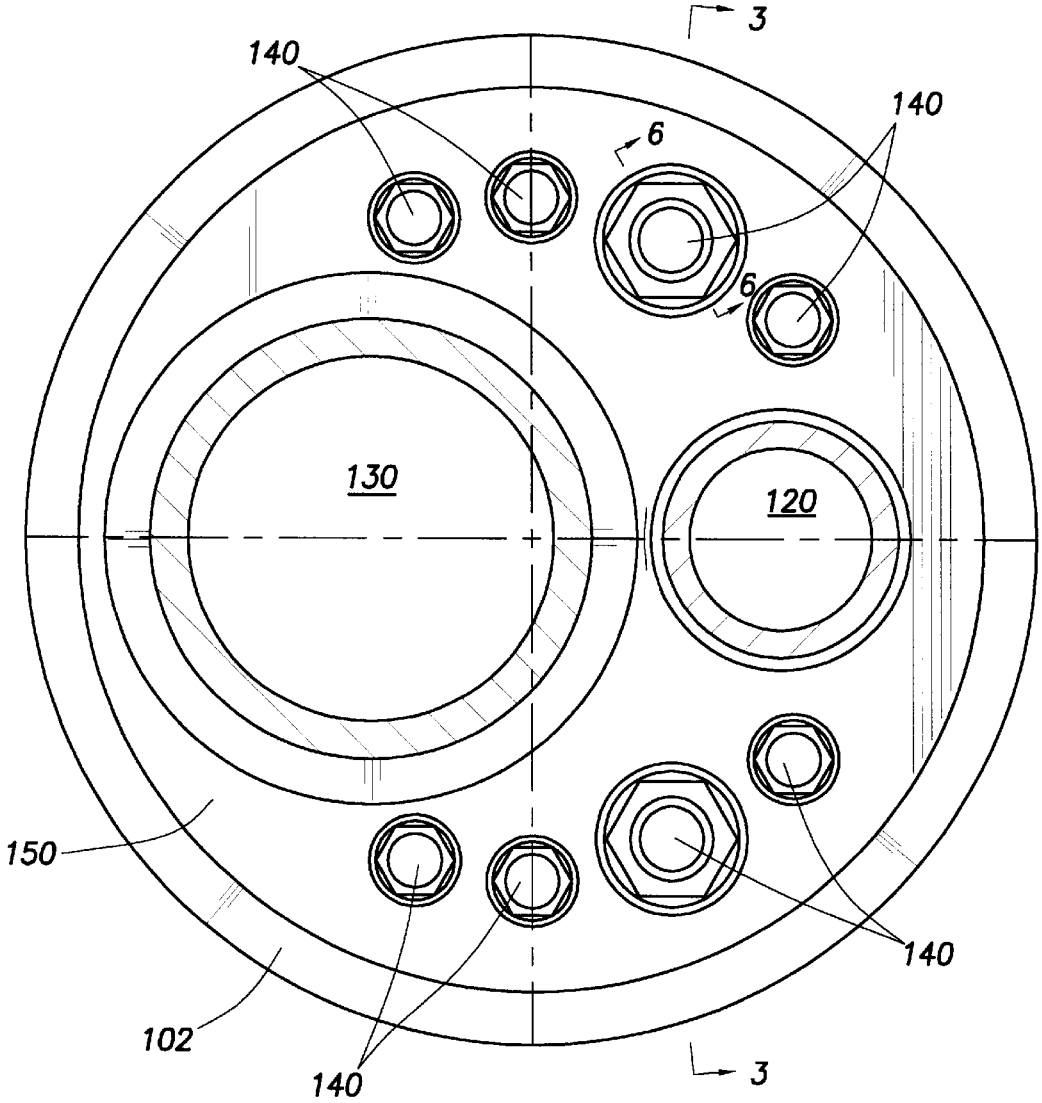
FIG. 2 is section view along line 2—2 of FIG. 1C.

The body 102 also includes one or more communication conduits 140 formed longitudinally there-through as shown in FIG. 2. Hydraulic, fiber optic, and/or electrical control lines 160 are often disposed through the conduits 140 to communicate surface equipment with sub-surface equipment. The control lines 160 are sealed within the packer 100 using a control line assembly which is disposed within a lock body 150. The lock body 150 is disposed on the second end of the body 102, and is essentially an extension of the body 102, as shown in FIG. 1C. Like the body 102, the lock body 150 includes the bores 120, 130, and the one or more communication conduits 140 disposed longitudinally there-through.

Considering the engagement assembly in more detail, the engagement assembly includes a sealing element 210, first and second gauge rings 212, 215, first and second cones 220, 250, cylinder 230, first and second pistons 235, 240, and slip 255, each disposed about the body 102. The engagement assembly further includes one or more snap rings 263, 265, 267, a first variable volume chamber 270, and a second variable volume chamber 280. A first port 275 formed in an outer surface of the body 102 allows for fluid communication between the large bore 130 and the first variable volume chamber 270, which is adjacent a first end of the first piston 235 and a second end of the second gauge ring 215. A second port 285 formed in the outer surface of the body 102 allows for fluid communication between the large bore 130 and the second variable volume chamber 280 (shown in FIG. 4C).

The engagement assembly further includes one or more "dogs" 260 to fix the cylinder 230 to the body 102. The "dogs" therefore prevent any pre-mature activation or movement of the packer 100 caused by an unavoidable contact against the borehole as the packer 100 is run down into the hole. The "dogs" 260 are housed within apertures formed in the second section of the cylinder 230, and a recessed groove formed in the outer surface of the body 102. The first section of the second piston 240 is disposed about the "dogs" 260 to keep the "dogs" 260 within the groove formed about the body 102. The operation of the dogs 260, the snap rings 263, 265, and 267 and the second chamber 280, will be discussed below with the operation of the packer 100.

The slip 255 is disposed about the body 102 between the first cone 220 and the second cone 250. An outer surface of the slip 255, preferably includes at least one outwardly extending serration or edged tooth 256, to engage an inner surface of a tubular 700 disposed there-around (shown in FIGS. 4A–4D). The slip 255 typically includes at least one recessed groove (not shown) milled therein to fracture under stress allowing the slip 255 to expand radially outward to engage the inner surface of the tubular 700. For example, the slip 255 may include four evenly sloped segments separated by equally spaced recessed grooves to contact the tubular 700 and become evenly distributed about the outer surface of the body 102.

An inner surface of the slip 255 has a first tapered end and a second tapered end corresponding to tapered surfaces of the first and second cones 220, 250. The tapered end of the first cone 220 rests underneath the first tapered end of the slip 255, and the tapered end of the second cone 250 rests underneath the second tapered surface of the slip 255. As will be explained in more detail below, the second cone 250 travels toward the first cone 220 which is securely held to the body 102. As a result, the slip 255 is forced radially outward and over the opposing tapered surfaces of the cones 220, 250 until the slip 255 engages the inner surface of the tubular 700.

The element 210 may have any number of configurations to effectively seal the annulus between the body 102 and the inner surface of the tubular 700. For example, the element 210 may include grooves, ridges, indentations, or extrusions designed to allow the element 210 to conform to variations in the shape of the interior of the tubular 700. The element 210 can be constructed of any expandable or otherwise malleable material which creates a permanent set position and stabilizes the body 102 relative to the tubular 700. For example, the element 210 may be a metal, plastic, elastomer, or any combination thereof.

The element 210 is disposed about the body 102 between the first gauge ring 212 and the second gauge ring 215. The first gauge ring 212 is threadably engaged to an outer surface of the second cone 220. As a result, the two members move together during the activation and release of the packer 100 which will be described below. The second gauge ring 215 consists of a first section and a second section having different outer diameters. The outer diameter of the first section is greater than the outer diameter of the second section thereby forming an interface or shoulder between the two sections.

The cylinder 230 has a first section and a second section whereby the first section of the cylinder 230 has a greater inner diameter and a greater outer surface than the second section. The first section is disposed about the second section of the second gauge ring 215 and abuts the shoulder formed by the two sections of the second gauge ring 215. The inner diameter of the second section abuts the outer diameter of the body 102. Annular grooves are disposed about an outer surface and an inner surface of the second section to house an elastomeric seal or the like to form a fluid barrier within the first chamber 270 formed between the body 102 and the ring housing 410.

More particularly, the first chamber 270 is formed within the inner diameter of the first section of the cylinder 230 and the outer surface of the body 102, between the second end of the second gauge ring 215 and a first end of the first piston 235. The first port 275 is formed through the body 102 to place the bore 130 in fluid communication with the first chamber 270. The first piston 235 and snap ring 263 are disposed about the body 102 within the chamber 270. The snap ring 263 prevents axial movement of the first piston 235 in a direction opposite the second gauge ring 215. Annular grooves are disposed about an outer surface and an inner surface of the first piston 235 to house an elastomeric seal or the like to form a fluid barrier between the cylinder 230 and the body 102. As will be explained below in more detail, fluid from the bore 130 travels through the port 275 into the chamber 270 and asserts a force against the second gauge ring 215 in a first direction and against the piston 235 in a second direction.

Considering the body lock ring assembly in more detail, the assembly includes a lock ring 410 and a ring housing 420. The body lock ring 410 is a cylindrical member radially disposed between the ring housing 420 and the lock body 150. The lock ring 410 includes an inner surface having profiles disposed thereon to mate with profiles formed on the outer surface of the lock body 150. A longitudinal cut within the lock ring 410 allows the lock ring 410 to expand radially and contract as it movably slides or ratchets in relation to the outer surface of the lock body 150.

The ring housing 420 is radially disposed about the cylinder 230 at a first end and the body lock ring 410 at a second end. At the first end, the ring housing 420 abuts the shoulder formed in the outer surface of the cylinder 230 and is threadably engaged to the second section of the cylinder 230. At the second end, the ring housing 420 has a jagged inner surface to engage a mating jagged outer surface of the lock ring 410. The relationship between the jagged surfaces creates a gap there-between allowing the lock ring 410 to expand radially as the profiles formed thereon move across mating profiles formed on the lock body 150. The profiles formed on the lock ring 410 have a tapered leading edge allowing the lock ring 410 to move across the mating profiles formed on the lock body 150 in one axial direction while preventing movement in the other direction.

In particular, the profiles formed on both the outer surface of the lock body 150 and the inner surface of the lock ring 410 consist of formations having one side which is sloped and one side which is perpendicular to the outer surface of the lock body 150. The sloped surfaces of the mating profiles allows the lock ring 410 to move across the body 102 in a single axial direction, whereas the perpendicular sides of the mating profiles prevent movement in the opposite axial direction. Therefore, the lock ring 410 may move or "ratchet" in one axial direction, but not the opposite axial direction.

The second chamber 280 is formed within the inner diameter of the ring housing 420 and the outer surface of the body 102, between the second end of the cylinder 230 and a first end of the lock body 150. The second port 285 formed in an outer surface of the body 102 provides for fluid communication between the bore 130 and the chamber 280.

The second piston 240 and snap rings 265 and 267 are disposed about the body 102 within the chamber 280. The second piston 240 is an annular member disposed about the body 102 adjacent the second end of the second gauge ring 215 and the lock body 150. The second piston 240 has a first section and a second section, whereby the first section has a greater inner diameter than the second section. The first section is disposed about an annular channel formed in the outer surface of the second section cylinder 230. The second section is disposed directly about the body 102. Annular grooves are disposed about an outer surface and an inner surface of the second section to house an elastomeric seal or the like to form a fluid barrier between the ratchet housing 420 and the body 102. As will be explained below in more detail, fluid from the bore 130 travels through the port 285 into the chamber 280 and asserts a force against the cylinder 230 in a first direction and against the piston 240 in a second direction. Within the chamber 280, the snap ring 265 prevents the axial movement of the piston 240 in a direction opposite the lock body 150, while the snap ring 267 prevents axial movement of the piston 240 in a direction opposite the cylinder 230.

Considering the retrieval assembly in more detail, the retrieval assembly includes a collet 510 and a support sleeve 520. The collet 510 is an annular, cylindrical member having a first section and a second section. The first section is a solid member which is threadably engaged to the body 102. The second section includes a plurality of collapsible members or fingers which are shouldered out against an inner surface of the lock body 150. The lock body 150, therefore, is held to the body 102 through the fingers of the collet 510.

The support sleeve 520 is an annular member disposed about the inner surface of second section of the collect release 510. The support sleeve 520 is affixed to the collet 510 through one or more shearable members 530, such as shear pins, for example. The removal of the support sleeve 520 allows the fingers of the collet 510 to collapse and thereby release the lock body 150. As will be described below, upon the collapse of the fingers, the fingers will disengage from the inner surface of the lock body 150 and allow the lock body 150 to travel away from the body 102, which thereby activates a cutting mechanism that severs the control line disposed there-through.

Figure 3:
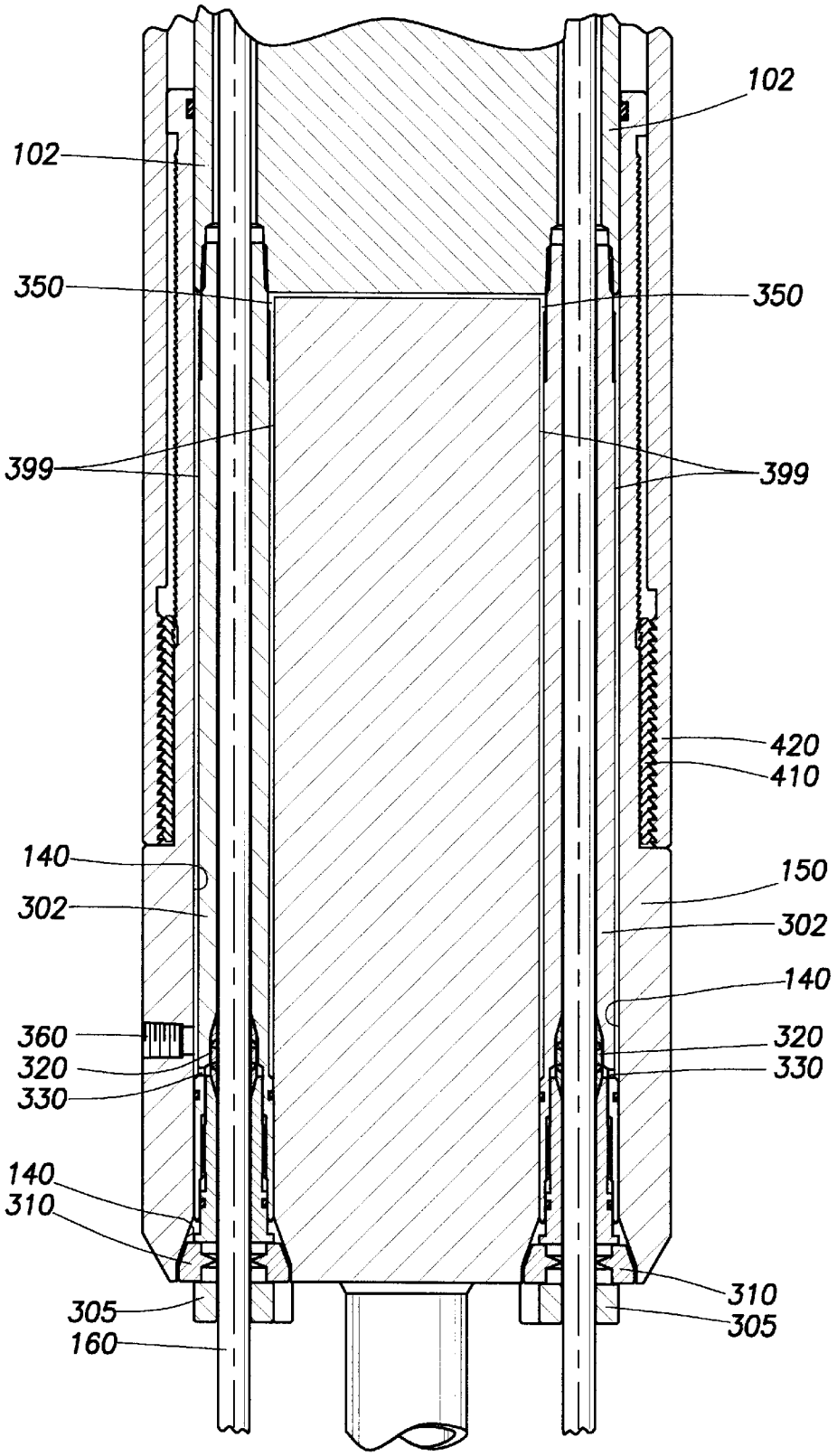
FIG. 3 is section view along angled lines 3—3 of FIG. 2.

Referring to FIGS. 2 and 3, each conduit 140 of the lock body 150 contains a control line assembly to sever the control lines 160 running through the respective conduit 140. Each control line assembly includes a seal sleeve 302, a wedge housing 305, one or more cutting wedges 310, and a ferrule fitting 320. The seal sleeve 302 is an annular, cylindrical member having a first end that is threadably engaged to the body 102. A first end of the wedge housing 305 is threadably engaged to a second end of the seal sleeve 302. A second end of the wedge housing 305 is a hexagonal head 307 or a comparable configuration, which is connectable to a tool, not shown, for operating the ferrule 320. The wedge housing 305 also has a plurality of apertures formed axially therein to be used in conjunction with the cutting wedges 310.

The cutting wedges 310 are disposed about the wedge housing 305 and housed within a flared second end of each conduit 140. The cutting wedges 310 are aligned with the apertures formed in the wedge housing 305, and when activated, the flared second end of the conduit 140 travels over the cutting wedges 310, forcing the cutting wedges 310 radially inward toward the control line 160. Accordingly, the cutting wedges 310 are forced into the apertures, thereby severing the control line 160.

As shown in FIG. 3, an annulus 399 is formed between an outer surface of each seal sleeve 302 and an inner surface of each communication conduit 140. A fluid chamber 350 is also formed between the interface of the body 102 and the lock body 150 such that each annulus 399 is in fluid communication with the fluid chamber 350. The fluid chamber 350, therefore, acts a manifold providing fluid communication between each annulus 399 for transferring fluid from one annulus 399 to another.

A test port 360 is disposed on the lock body 150 and is used to simultaneously pressure test each control line assembly disposed in the packer 100. The test port 360 is in fluid communication with a first annulus 399 formed about a first seal sleeve 302. A test fluid, preferably a liquid, is introduced through the test port 360 to the first annulus 399. The test fluid travels within the first annulus 399 to the fluid chamber 350. From the fluid chamber 350, the fluid travels via each annulus 399 to the test holes 330 disposed on the ferrule fittings 320. Accordingly, each ferrule fitting 320 can be pressure tested simultaneously to ensure a proper fluid seal within each conduit.

FIGS. 4A–4D are a section view of the packer 100 shown in a set position within a tubular 700. To set or actuate the packer 100, the packer 100 is first attached within a string of tubulars (not shown) and control lines (not shown), and run down a wellbore to a desired location. Fluid pressure within the bore 130 is supplied to the first and second chambers 270, 280, through their respective ports 275, 285. The fluid pressure within the chambers 270, 280, is substantially equal to the pressure within the bore 130.

Within the second chamber 280, the fluid pressure forces the second piston 240 in a second direction toward the snap ring 267. The second piston 240 transfers force through the snap ring 267 to the body 102 which transfers the force into the lock body 150. Since the ratchet housing 420 is threadably engaged to the cylinder 230, the lock body 150 moves relative to the body lock ring assembly which causes the lock ring 410 to ratchet across the lock body 150 in the first direction. Movement of the second piston 240 also uncovers the "dogs" 260 which disconnects the cylinder 230 from the body 102. Consequently, the fluid pressure moves the cylinder 230 in a first direction toward the engagement assembly.

Within the first chamber 270, the fluid pressure moves the first piston 235 in the second direction against the snap ring 263. The snap ring 263 transfers the force to the body 102. In the first direction, the fluid pressure exerts a force against the second gauge ring 215, moving the ring 215 toward the engagement assembly. Since the second gauge ring 215 and the cylinder 230 are threadably engaged as well as shouldered out, the two members 215, 230 move in the first direction together. Moreover, since the two members 215, 230 are tied together, the sum of the forces within the volumes of the first chamber 270 and the second chamber 280 is asserted against the members 215, 230 in the first direction. Accordingly, the volumes of the respective chambers 270, 280 can be smaller than if they were to operate individually.

Figure 4A:
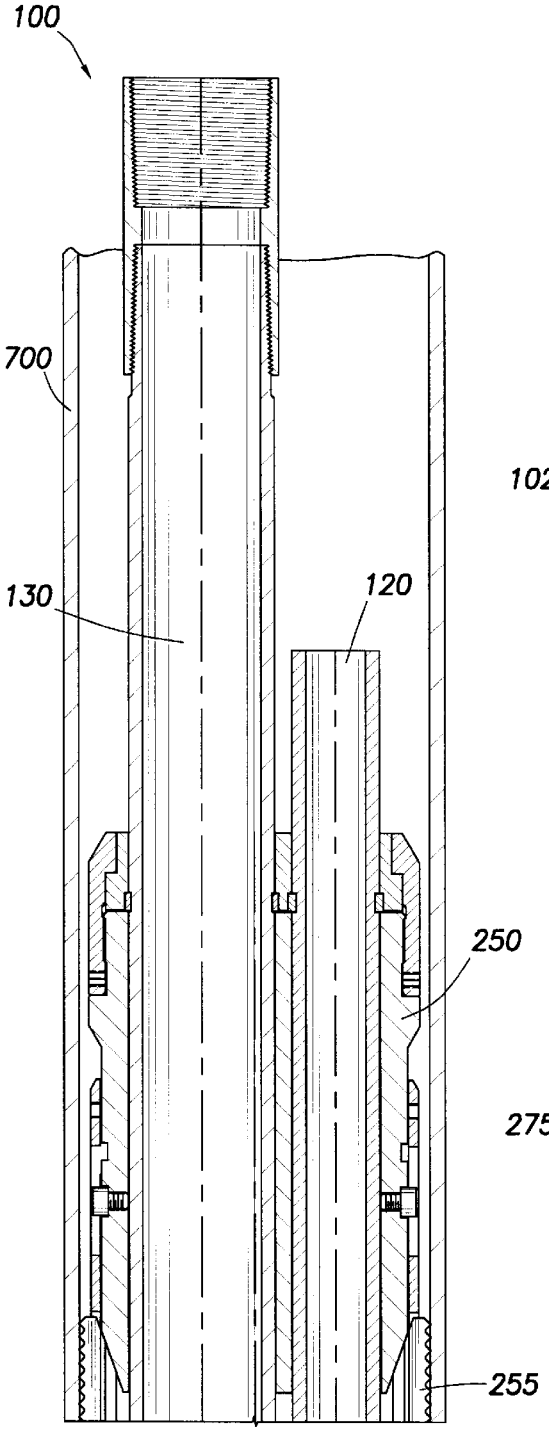
FIGS. 4A–4D are a section view of the packer of FIGS. 1A–1D shown in a set position.
Figure 4B:
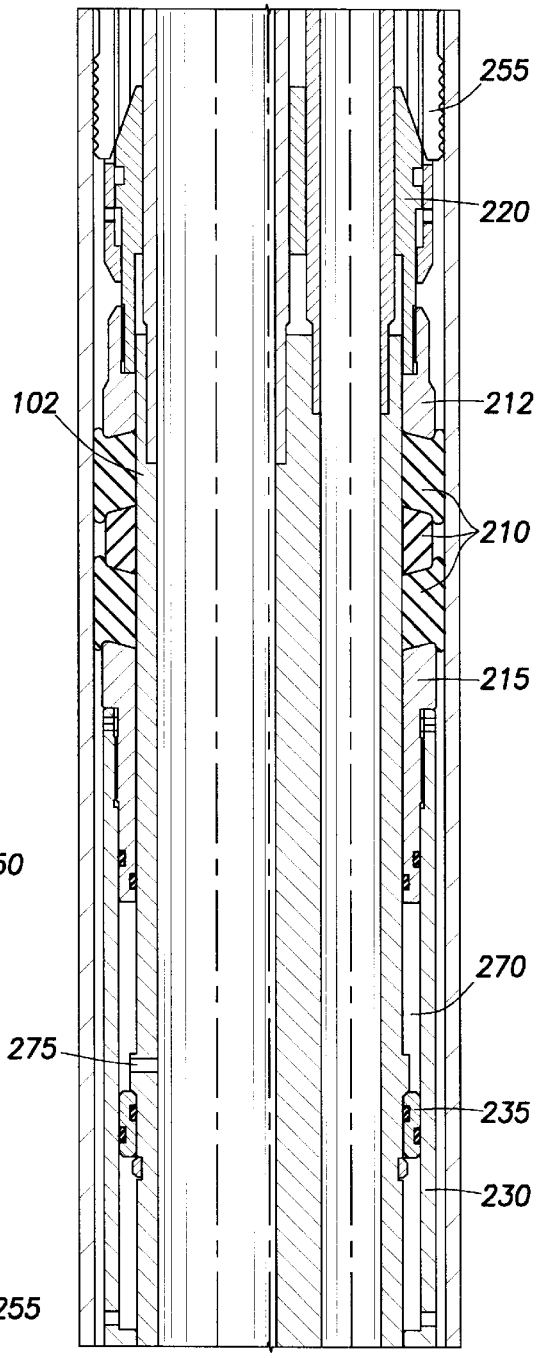
Figure 4C:
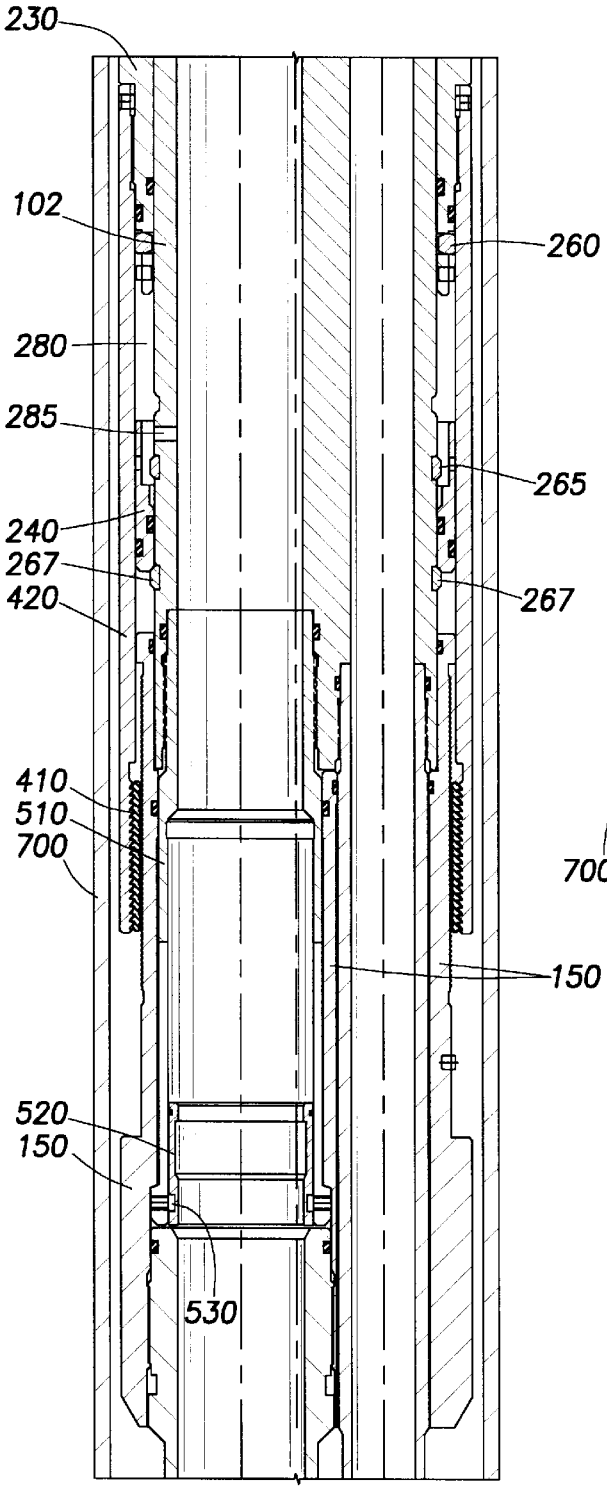
Figure 4D:
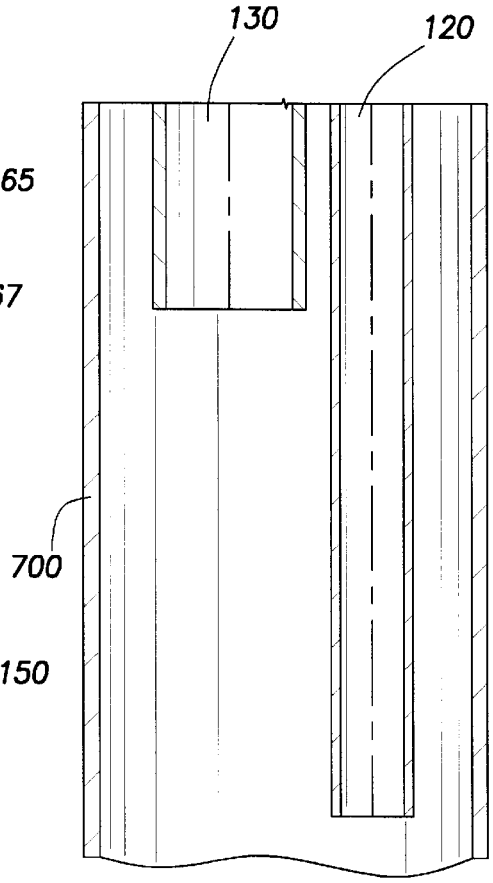
Figure 5A:
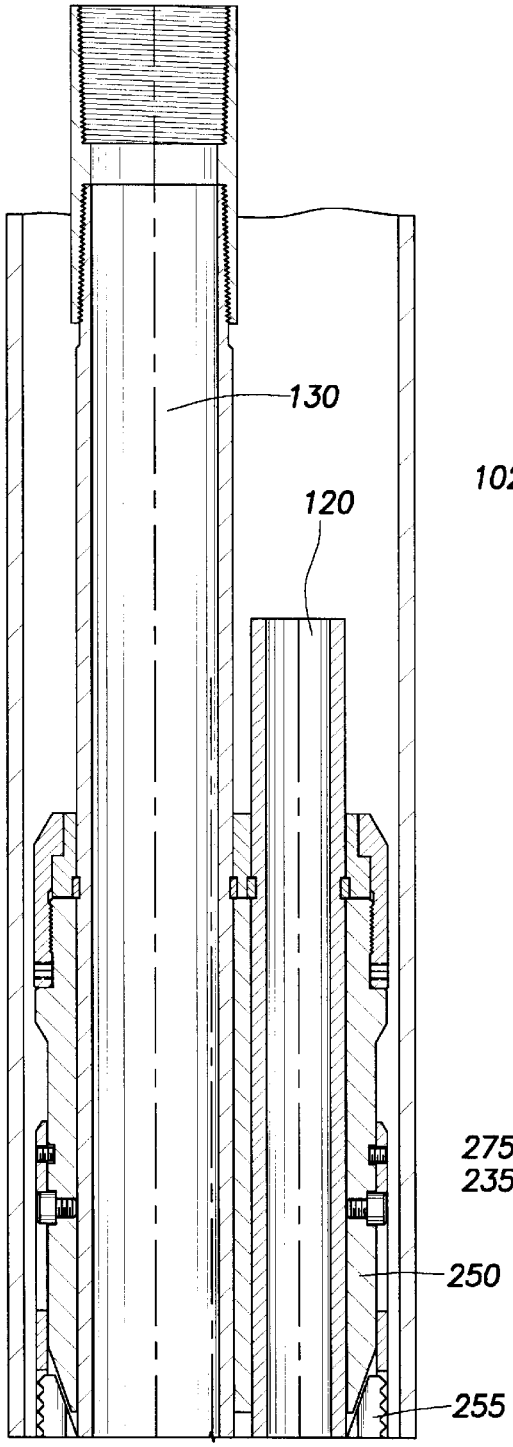
FIGS. 5A–5D are a section view of the packer of FIGS. 1A–1D shown in a released position.
Figure 5B:
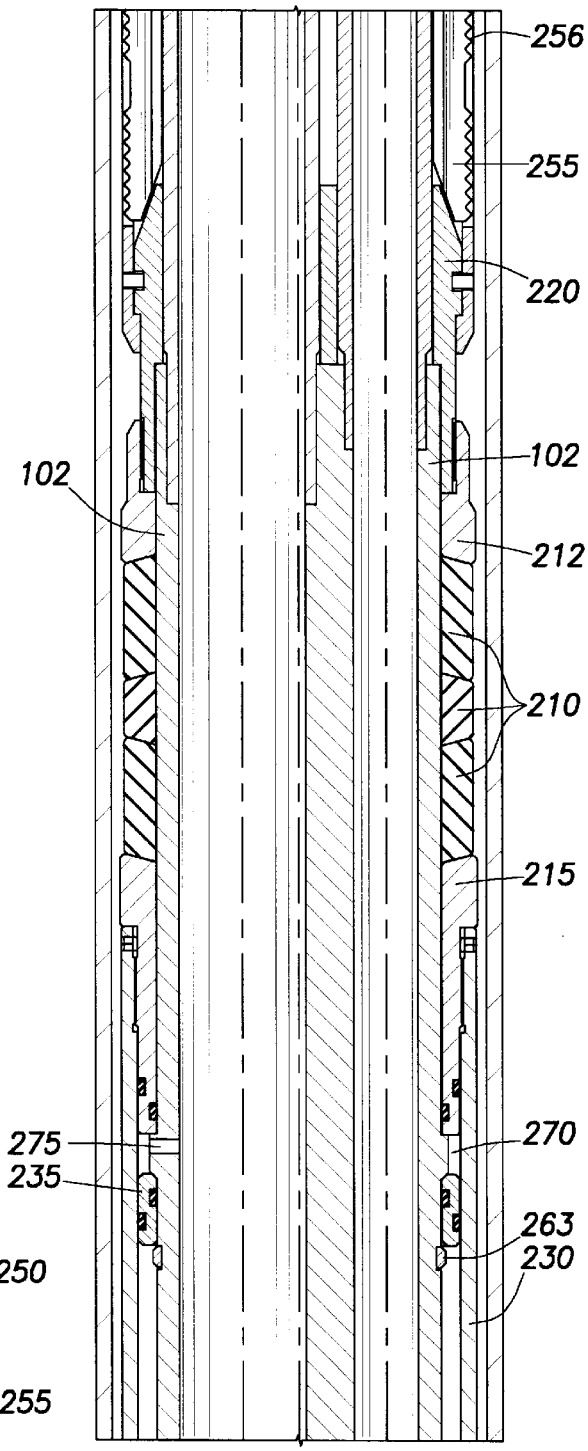
Figure 5C:
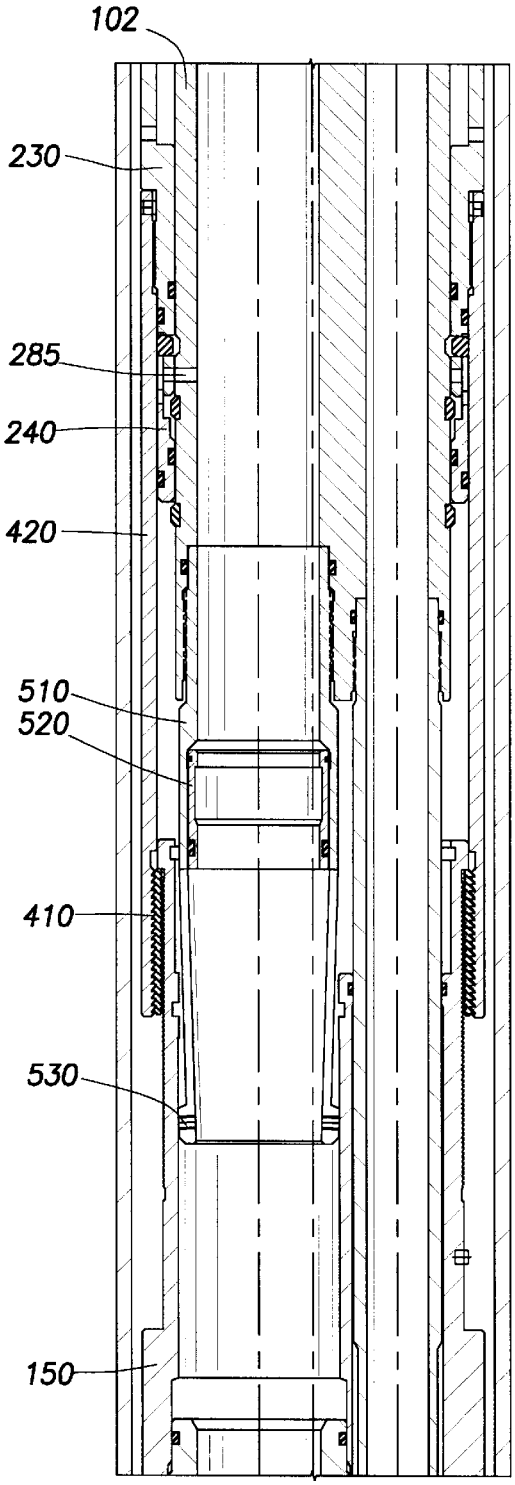
Figure 5D:
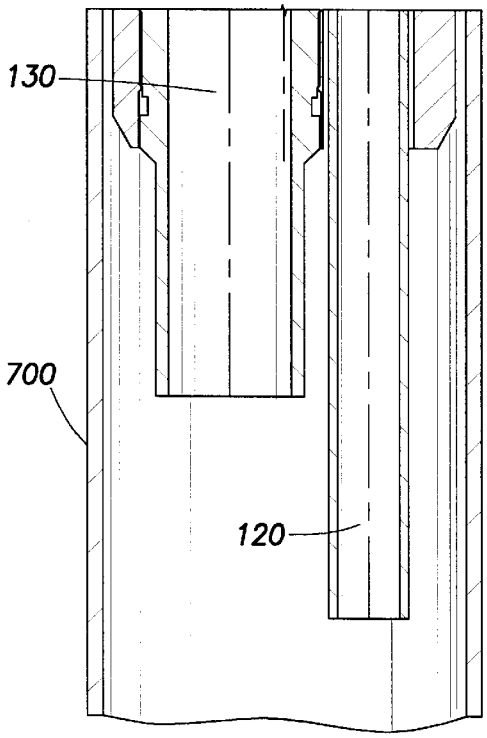

Continuing in the first direction, the cylinder 230 and second gauge ring 215 transfer the force through the sealing element 210 to the first gauge ring 212, which is threaded to the second cone 250. The first cone 220 is held securely to the body 102, thereby exerting an equal and opposite force against the members moving in the first direction. Accordingly, the second cone 250 moves underneath the slip 255, driving the slip 255 up an over the tapered surfaces of the first cone 220 and the second cone 250, and radially outward toward the tubular 700, as shown in FIGS. 4A and 4B. At the same time, the first and second gauge rings 212, 215, longitudinally compress and radially expand the element 210 toward the tubular 700, as shown in FIG. 4B.

To retrieve the packer 100 and controllably sever the control lines 160, a retrieval tool, not shown, is attached to the support sleeve 520. The tool applies a force in the first direction to the support sleeve 520 to shear the shearable members 530 holding the support sleeve 520 to the collet 510. Referring to FIGS. 5A–5D, once the shearable members 530 release, the support sleeve 520 travels axially in the first direction along the collet 510 from a first position to a second position. The release of the support sleeve 520 allows the fingers of the collet 510 to collapse radially inward, thereby disengaging the lock body 150 from the collet 510. Consequently, the lock body 150 is free to move independently of the body 102 in the second direction by the weight of the tubing string attached thereto.

As the lock body 150 moves in the second direction away from the body 102, the body lock ring assembly ratchets in the first direction across the lock body 150 until the lock ring 410 contacts the shoulder formed in the outer surface of the first end of the lock body 150. At this point, the body lock ring assembly now moves with the lock body 150. Since the lock ring housing 420 is threadably engaged to the cylinder 230 which is threadably engaged to the second gauge ring 215, the slip 255 and the element 210 are allowed to relax and move radially inward away from the tubular 700, thereby disengaging the packer 100 from the wellbore.

Figure 6:
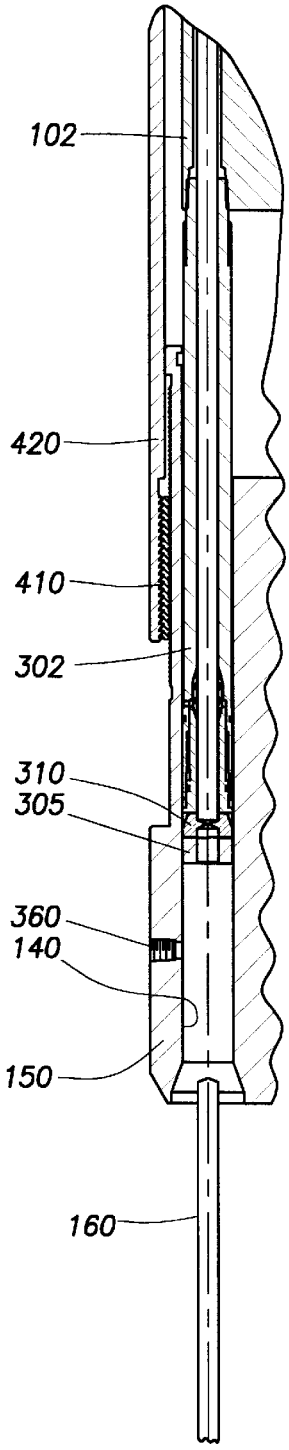
FIG. 6 is a section view of a control line assembly along lines 6—6 of FIG. 2.

In addition, movement of the lock body 150 away from the body 102 activates the control line assemblies which controllably sever the control lines 160 as shown in FIG. 6. In particular, movement of the lock body 150 in the second direction, opposite the body 102, causes the wedges 310 to travel up the slope of the tapered second end of the conduits 140 thereby forcing the wedges 310 into the apertures of the wedge housing 305. Consequently, the sharp surfaces of the wedges contact the control lines 160 and sever the control lines 160 at the point of contact.

In addition to the packer 100 described above, FIG. 7 is a section view of a packer 200 shown in a run position having a release mechanism disposed in the first bore 120. Due to the physical properties of the production fluid, a release mechanism in the production tubing may become unreliable. For example, paraffins in the production fluid have a tendency to accumulate and collect on the release mechanism and thereby effectively prevent the operation of the mechanism. Therefore, it is desirable to have the release mechanism disposed within the non-production bore 120, as shown in FIGS. 7–10.

The packer 200 includes an engagement assembly, one or more control line assemblies, a body lock ring assembly, and a retrieval assembly. The engagement assembly, body lock ring assembly, and control line assembly are similar to those described above for the packer 100, and therefore, utilize the same numeric identification. The different retrieval assembly of the packer 200 includes a support sleeve 600, a containment ring 610, a stopper 620, and a release sleeve 630.

The support sleeve 600 is disposed within the second bore 130, and connects the lock body 150 to the body 102. The support sleeve 600 is a cylindrical member and is threadably engaged to the second bore 130 at a first end thereof. At a second end, the support sleeve 600 has a plurality of concentric grooves formed in an outer surface thereof to engage mating concentric grooves formed in an inner surface of the containment ring 610.

The containment ring 610 is a split-ring disposed about the second end of the support sleeve 600, and is disposed within a window formed in an inner surface of the lock body 150. As stated above, the containment ring 610 has a plurality of concentric grooves formed in an inner surface thereof to matably engage the grooves of the support sleeve 600. The containment ring 610 also has at least two axially recessed grooves 612, 614, formed in an outer surface thereof, as shown in FIG. 8.

Figure 7:
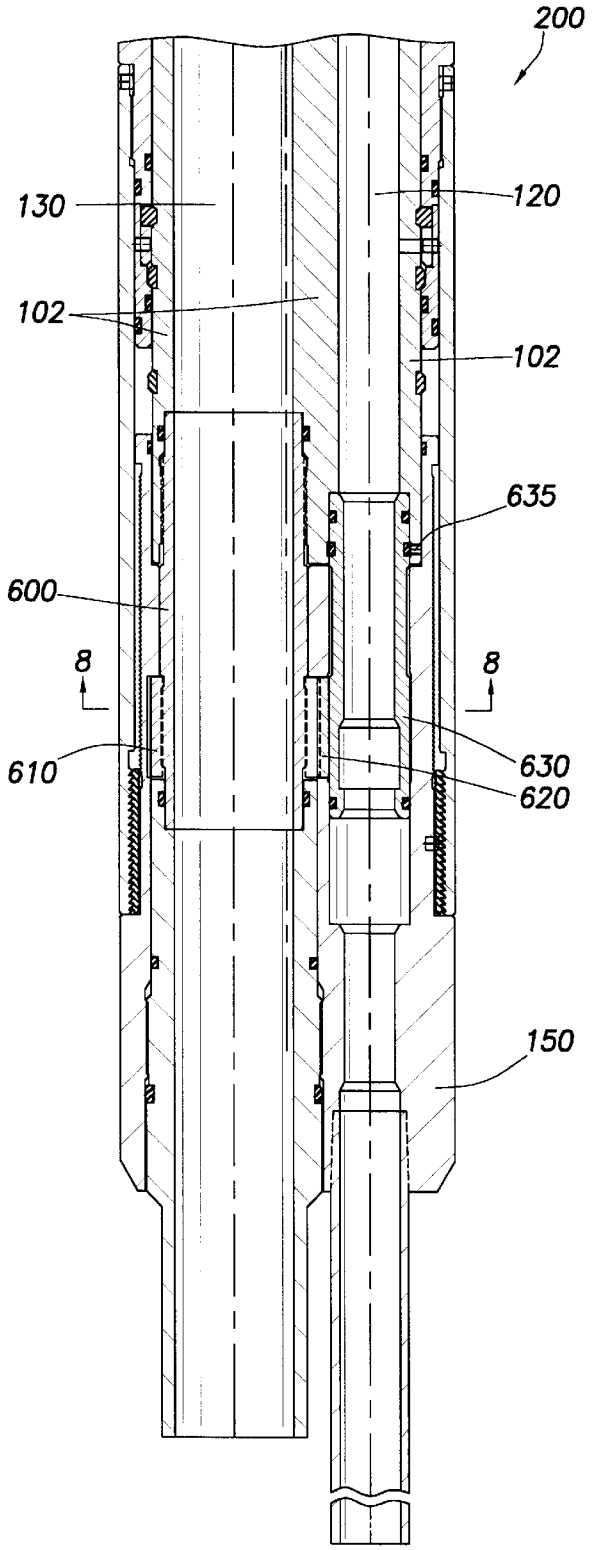
FIG. 7 is a section view of a packer of the present invention in a run-in position having a release mechanism disposed within a small diameter bore.

Referring to FIGS. 7 and 8, the stopper 620 is disposed about the containment ring 610 and has one or more legs 625 extending from an inner surface thereof that are disposed within the recessed grooves 612, 614, of the containment ring 610. The legs 625 prevent the containment ring 610 from splitting open until retrieval of the packer 200 is desired.

Figure 9:
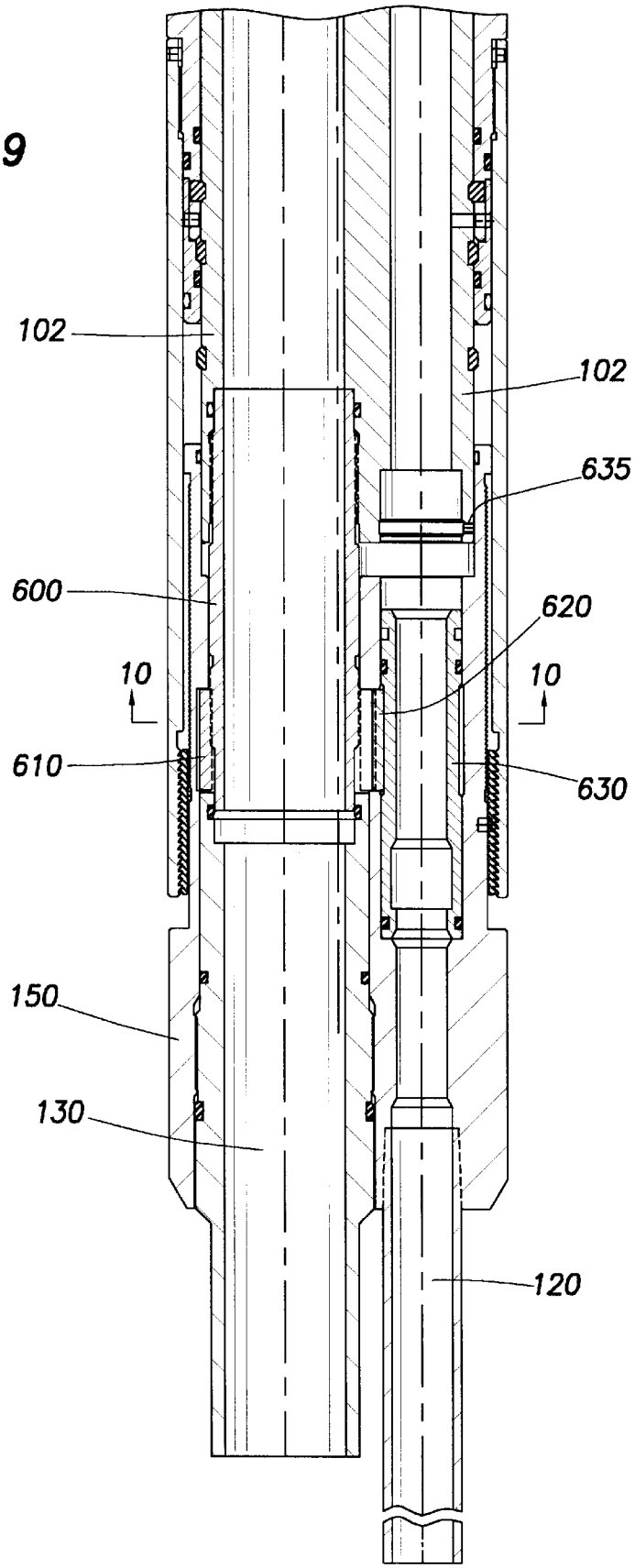
FIG. 9 is a section view of the packer of FIG. 7 shown in a released position.

The release sleeve 630 is disposed within the first bore 120 and covers an outer surface of the stopper 620. The release sleeve 630 holds the stopper 620 against the containment ring 610. A first end of the release sleeve 630 is attached to the body 102 through a shearable member 635, such as a shear pins, for example. Upon the release of the release sleeve 630, the stopper 620 is uncovered and allowed to disengage from the containment ring 610 as shown in FIGS. 9 and 10. Once the stopper 620 is released, the containment ring 610 expands open, disengaging its concentric grooves from the concentric grooves formed in the support sleeve 600. The lock body 150 is therefore released from the body 102. As described above, axial movement of the lock body 150 in the second direction, away from the body 102, activates the cutting mechanisms disposed within the control line assemblies, and also disengages the slip 255 and element 210 from the tubular 700 there-around.

The aspects of the invention described herein are not limited to uses in a packer and could have similar uses in any wellbore component. Furthermore, while foregoing is directed to the preferred embodiment of the present invention, other and further embodiments of the invention may be devised without departing from the basic scope thereof, and the scope thereof is determined by the claims that follow.

What is claimed is:

1. A packer for sealing an annulus in a wellbore, comprising:

a body having one or more conduits formed longitudinally there-through, wherein the one or more conduits comprise a cutting member for severing a control line disposed therein;

a chamber disposed within the body, wherein the chamber is in fluid communication with each of the one or more conduits;

an inlet in fluid communication with one of the conduits for pressurizing the chamber; and a sealing element disposed on the body for sealing an annular area between the packer and the wellbore.

2. The packer of claim 1, wherein the one or more conduits comprise an enlarged first end that provides a housing for the cutting member.

3. The packer of claim 1, wherein releasing the packer compresses the cutting member into the control line thereby severing the control line.

4. The packer of claim 1, wherein the body comprises one or more longitudinal bores disposed there-through.

5. A packer for sealing an annulus in a wellbore, comprising:

a body having one or more conduits formed longitudinally there-through, wherein the one or more conduits comprise a seal mandrel disposed therein;

a chamber disposed within the body, wherein the chamber is in fluid communication with each of the one or more conduits;

an inlet in fluid communication with one of the conduits for pressurizing the chamber; and a sealing element disposed on the body for sealing an annular area between the packer and the wellbore.

6. The packer of claim 5, wherein the one or more conduits comprises an annular cavity formed between an outer surface of the seal mandrel and an inner surface of the mandrel body.

7. The packer of claim 6, wherein the annular cavities are in fluid communication with the chamber.

8. The packer of claim 7, wherein the chamber acts as a manifold for pressure testing the one or more conduits.

9. A packer for sealing an annulus in a wellbore, comprising:

a body having one or more conduits formed longitudinally there-through;

a chamber disposed within the body, wherein the chamber is in fluid communication with each of the one or more conduits;

an inlet in fluid communication with one of the conduits for pressurizing the chamber, wherein pressurized fluid is applied through an aperture to determine leaks within the one or more conduits; and a sealing element disposed on the body for sealing an annular area between the packer and the wellbore.

10. A packer for sealing an annulus in a wellbore, comprising:

a body having one or more conduits formed longitudinally there-through and one or more longitudinal bores disposed there-through, wherein the one or more longitudinal bores comprise one or more production bores and one or more non-production bores;

a chamber disposed within the body, wherein the chamber is in fluid communication with each of the one or more conduits;

an inlet in fluid communication with one of the conduits for pressurizing the chamber; and a sealing element disposed on the body for sealing an annular area between the packer and the wellbore.

11. A packer for sealing an annulus in a wellbore, comprising:

a body having one or more conduits formed longitudinally there-through and one or more longitudinal bores disposed there-through, wherein the one or more longitudinal bores comprise a smaller diameter bore and a larger diameter bore;

a chamber disposed within the body, wherein the chamber is in fluid communication with each of the one or more conduits;

an inlet in fluid communication with one of the conduits for pressurizing the chamber; and a sealing element disposed on the body for sealing an annular area between the packer and the wellbore.

12. A packer for sealing an annulus in a wellbore, comprising:

a body having one or more conduits formed longitudinally there-through;

a chamber disposed within the body, wherein the chamber is in fluid communication with each of the one or more conduits;

an inlet in fluid communication with one of the conduits for pressurizing the chamber;

a sealing element disposed on the body for sealing an annular area between the packer and the wellbore; and a release assembly comprising:

a lock body disposed on a first end of the body, wherein the lock body comprises a recessed groove formed in an inner surface thereof;

an expandable ring disposed within the recessed groove, wherein the expandable ring comprises concentric grooves disposed on an inner surface thereof which mateably engage concentric grooves disposed about an outer surface of the body;

a releasable collar at least partially disposed about the expandable ring; and a slideable sleeve at least partially disposed about the releasable collar.

13. The packer of claim 12, wherein the slideable sleeve comprises a recessed groove formed in an inner surface thereof.

14. The packer of claim 13, wherein movement of the slideable member aligns the recessed groove of the slideable member with the releasing collar, allowing the expandable ring to expand and release the packer.

15. The packer of claim 12, wherein the release assembly is disposed within the smaller diameter bore.

16. A packer for sealing an annulus in a wellbore, comprising:

a body having one or more conduits formed longitudinally there-through;

a chamber disposed within the body, wherein the chamber is in fluid communication with each of the one or more conduits;

an inlet in fluid communication with one of the conduits for pressurizing the chamber;

a sealing element disposed on the body for sealing an annular area between the packer and the wellbore; and a release assembly comprising:

a lock body disposed on a first end of the body;

a collapsible member threadably engaged with the body at a first end and shouldered against the lock body at a second end; and a slideable member disposed within the collapsible member.

17. The packer of claim 16, wherein movement of the slideable member allows the collapsible member to collapse inwardly and release the packer.

18. The packer of claim 17, wherein the release assembly is disposed within the larger diameter bore.-

19. A packer for sealing an annulus in a wellbore, comprising:

a body having one or more conduits formed there-through, wherein the one or more conduits comprise:

a seal mandrel disposed therein; and one or more annular cavities formed between an outer surface of the seal mandrel and an inner surface of the mandrel body; and a chamber disposed within the body, wherein the chamber is in fluid communication with each of the one or more conduits.

20. The packer of claim 19, wherein the annular cavities are in fluid communication with the chamber.

21. A packer for sealing an annulus in a wellbore, comprising:

a body having one or more conduits formed there-through, wherein the one or more conduits comprise a seal mandrel disposed therein; and a chamber disposed within the body, wherein the chamber is in fluid communication with each of the one or more conduits, wherein the chamber acts as a manifold for pressure testing the one or more conduits.

22. A packer for sealing an annulus in a wellbore, comprising:

a body having one or more conduits formed there-through, wherein the one or more conduits comprise a seal mandrel disposed therein;

a chamber disposed within the body, wherein the chamber is in fluid communication with each of the one or more conduits; and an aperture disposed on the body wherein pressurized fluid is applied through the aperture to determine leaks within the one or more conduits.

23. A method of pressure testing conduits of a packer, comprising:

flowing a fluid into a body, the body comprising:

one or more conduits formed there-through, wherein the one or more conduits comprise a seal mandrel disposed therein and one or more annular cavities formed between an outer surface of the seal mandrel and an inner surface of the body; and a chamber disposed within the body, wherein the chamber is in fluid communication with the annular cavities.

24. A method of pressure testing conduits of a packer, comprising:

flowing a fluid into a body, the body comprising:

one or more conduits formed there-through, wherein the one or more conduits comprise a seal mandrel disposed therein and one or more annular cavities formed between an outer surface of the seal mandrel and an inner surface of the body; and a chamber disposed within the body, wherein the chamber is in fluid communication with the annular cavities, wherein the chamber acts as a manifold for pressure testing the one or more conduits.

25. A method of pressure testing conduits of a packer, comprising:

flowing a fluid into a body comprising:

one or more conduits formed there-through, wherein the one or more conduits comprise a seal mandrel disposed therein and one or more annular cavities formed between an outer surface of the seal mandrel and an inner surface of the body; and a chamber disposed within the body, wherein the chamber is in fluid communication with the annular cavities, wherein the fluid flows in a first direction through one of the annular cavities to the chamber and flows in a second direction from the chamber through the remainder of the annular cavities.

* * * * *